US005741204A

United States Patent [19]

Lee

[11] Patent Number: 5,741,204

[45] Date of Patent: Apr. 21, 1998

[54] STRUCTURE OF JOGGER EXERCISER

[76] Inventor: Kuo-Ron Lee, No. 61, Mai Jou II Rd., Yi Lan City, Taiwan

[21] Appl. No.: 796,732

[22] Filed: Feb. 6, 1997

[51] Int. Cl.[6] ..... A63B 22/00; A63B 71/00

[52] U.S. Cl. ..... 482/51; 482/52; 482/114

[58] Field of Search ..... 482/51, 52, 79, 482/80, 54, 114, 118, 115

[56] References Cited

U.S. PATENT DOCUMENTS

| | | | |
|---|---|---|---|
| 4,850,585 | 7/1989 | Dalebout | 482/118 X |
| 5,207,622 | 5/1993 | Wilkinson et al. | 482/54 |
| 5,344,376 | 9/1994 | Bostic et al. | 482/114 X |
| 5,584,780 | 12/1996 | Lin | 482/51 |
| 5,584,781 | 12/1996 | Chen | 482/51 |
| 5,603,675 | 2/1997 | Wu | 482/51 X |
| 5,605,521 | 2/1997 | Hsieh | 482/51 |
| 5,616,103 | 4/1997 | Lee | 482/51 |
| 5,624,354 | 4/1997 | Chen | 482/51 |

*Primary Examiner*—Stephen R. Crow
*Assistant Examiner*—Denise Pothier
*Attorney, Agent, or Firm*—Varndell Legal Group

[57] ABSTRACT

A jogger exerciser including a first support frame and a second support frame pivoted together, two struts connected between the support frames, two knuckle members respectively and fixedly mounted on two top ends of the first support frame, two swing members respectively turned about the knuckle members and having a respective hand grip at the top and a respective foot plate at the bottom, and a transverse top frame connected between the knuckle members, wherein a pairs of pivoted links are respectively coupled between two opposite ends of a pivot in the transverse top frame and the two swinging members to guide the swinging of the swing members and to limit their swinging angle.

2 Claims, 9 Drawing Sheets

STRUCTURE OF JOGGER EXERCISER

BACKGROUND AND SUMMARY OF THE INVENTION

The present invention relates to jogger exercisers, and more particularly to such a jogger exerciser which is stable and save in use.

U.S. patent Ser. No. 08/510.838, which was invented by the present inventor, discloses a jogger exerciser including two swing members rotatably associated with two support frames and a hand grip detachably connected to a top portion of the support frames. To use this jogger exerciser, firmly hold the hand grip, stably stand on the treads of the swing members, and then relaxedly stretch the whole body and alternately swing the swing members with feet back and forth. This structure of jogger exerciser is functional, however because the swinging angle of the swing members is not limited, the swinging of the swing members is not stable. It is dangerous to swing the swing members over a certain swinging angle.

The present invention has been accomplished to provide an improved structure of jogger exerciser which eliminates the aforesaid problem. According to one aspect of the present invention, the jogger exerciser comprises a first support frame and a second support frame pivoted together, two struts connected between the support frames, two knuckle members respectively and fixedly mounted on two top ends of the first support frame, two swing members respectively turned about the knuckle members and having a respective hand grip at the top and a respective foot plate at the bottom, and a transverse top frame connected between the knuckle members, wherein a pairs of pivoted links are respectively coupled between two opposite ends of a pivot in the transverse top frame and the two swinging members to guide the swinging of the swing members and to limit their swinging angle. According to another aspect of the present invention, the knuckle members have a respective substantially U-shaped lug at a back side respectively pivot to two opposite ends of the transverse top frame, and fixedly secured in position by a respective substantially U-shaped locating frame and a respective tightening up screw. The U-shaped locating frame is detachably secured to the U-shaped lug and one end of the transverse top frame by the respective tightening up screw. When the tightening up screw is unfastened, the respective U-shaped lug can then be detached from the respective U-shaped lug and the transverse top frame, so that the transverse top frame can be collapsed and closely attached to the first support frame.

DETAILED DESCRIPTION OF THE PREFERRED EMBODIMENT

Figure 1:
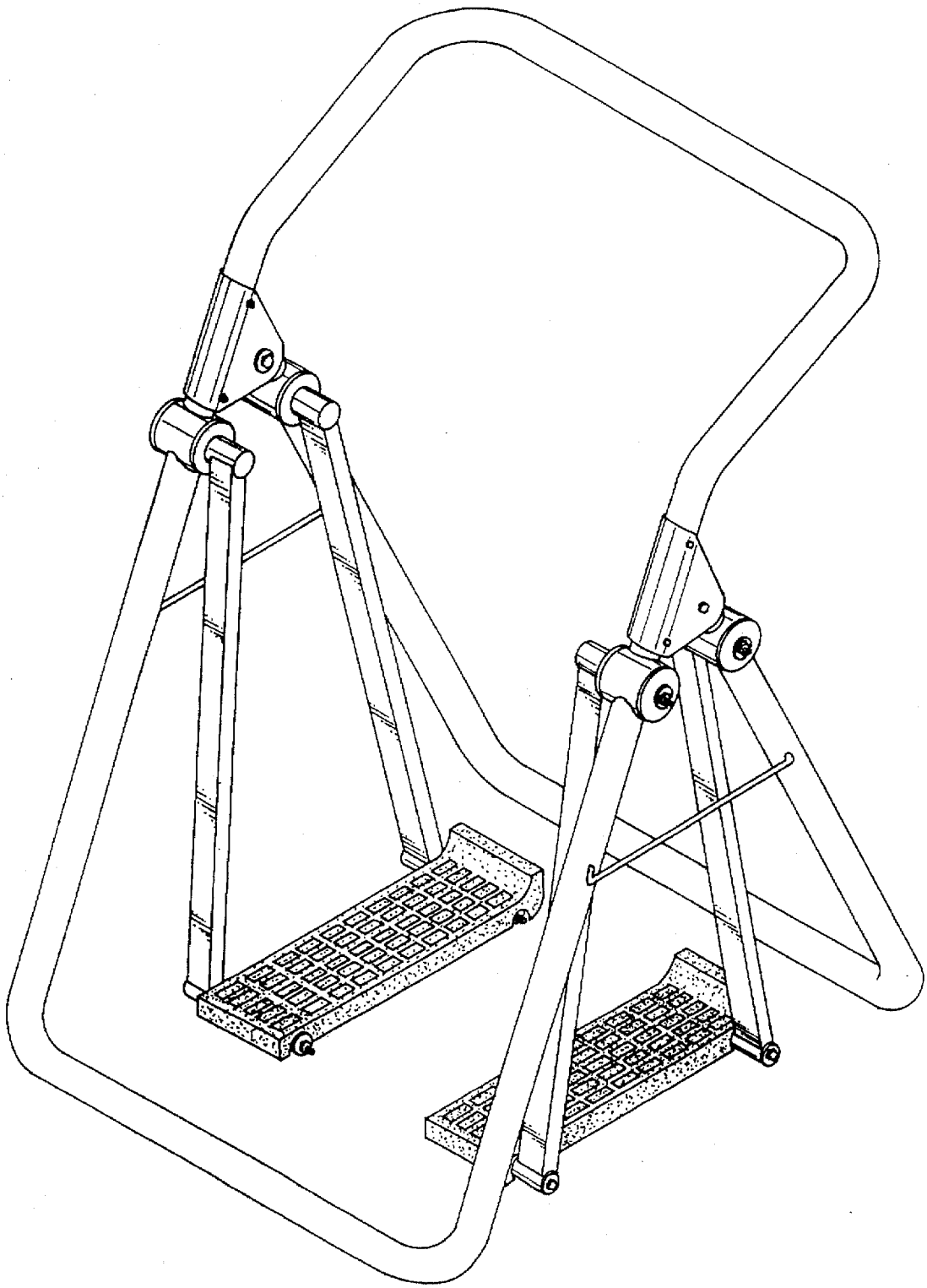
Fig. 1 PRIOR ART
FIG. 1 is an elevational view of a jogger exerciser according to U.S. patent Ser. No. 08/510,838.
Figure 2:
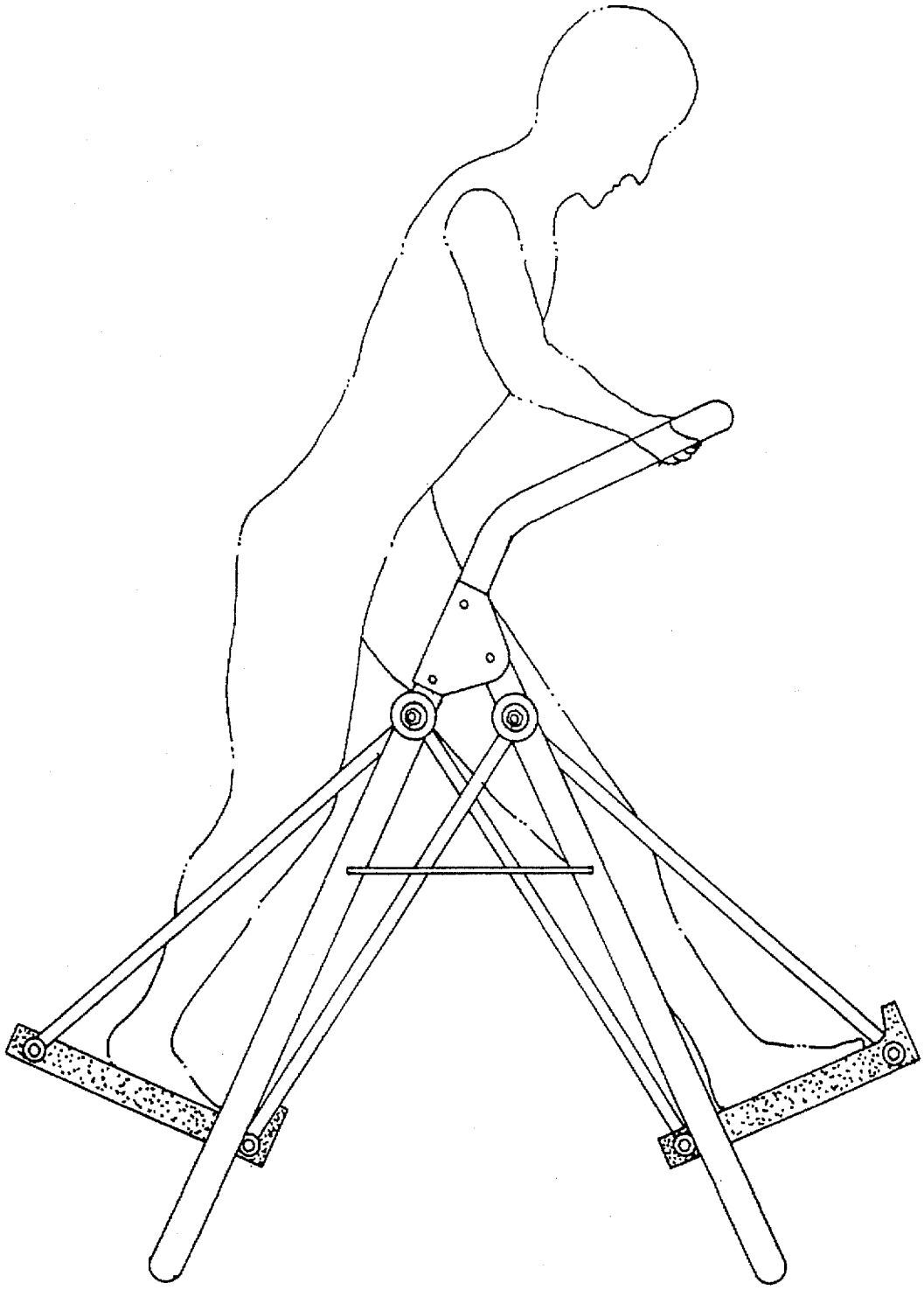
Fig. 2 PRIOR ART
FIG. 2 is an applied view of the jogger exerciser shown in FIG. 1, showing the swing members operated.
Figure 3:
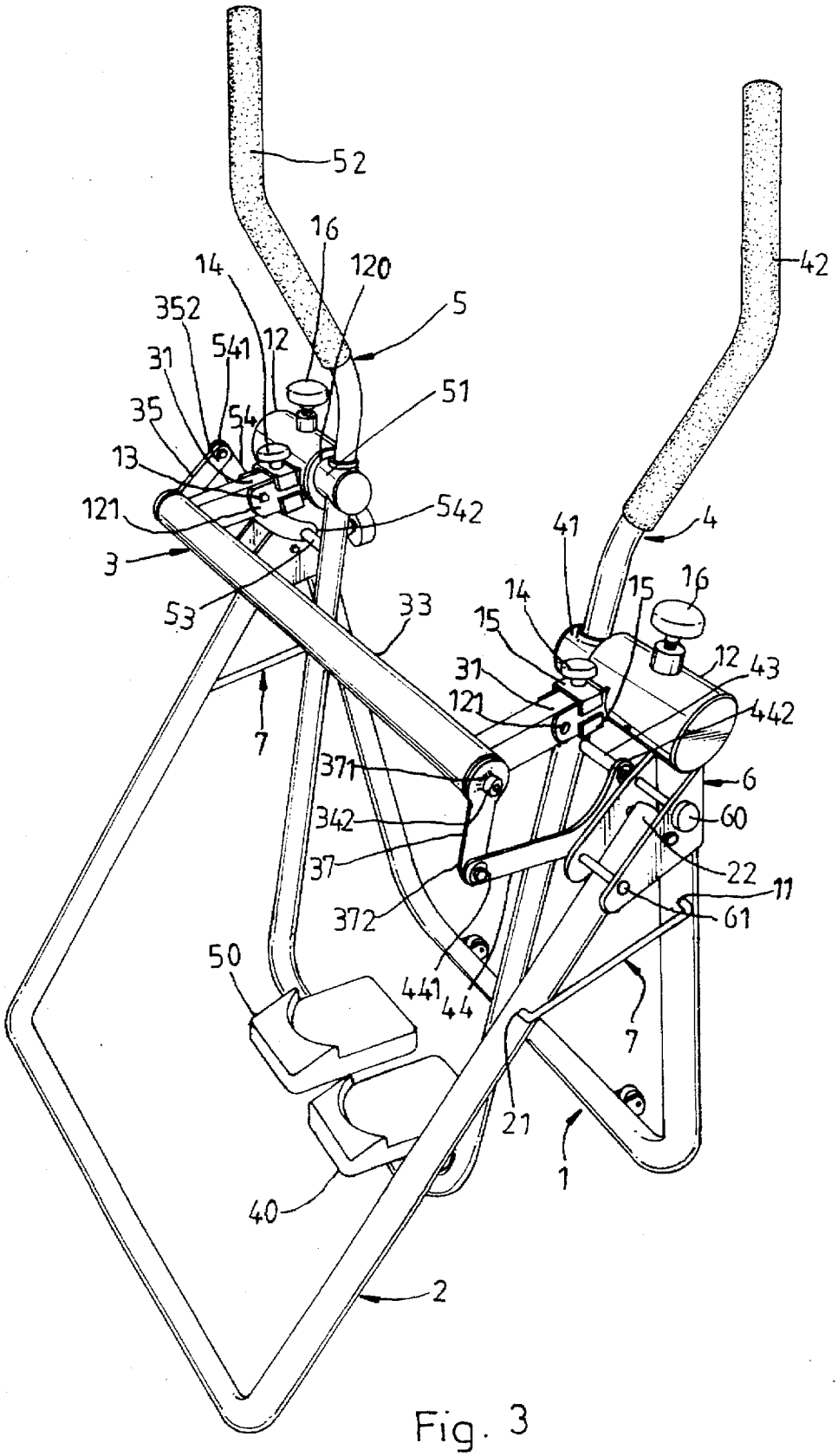
FIG. 3 is an elevational view of a jogger exerciser according to the present invention.

Referring to FIGS. from 3 to 7, a jogger exerciser in accordance with the present invention is generally comprised of a first support frame 1, a second support frame 2, a transverse top frame 3, a first swing member 4, a second swing member 5, two unions 6, and two struts 7.

The first support frame 1 is a substantially U-shaped frame formed from a pipe, having a transverse lower portion directly disposed on the ground or the floor as a base, and two vertical portions upwardly extended from two opposite ends of the transverse lower portion. Each vertical portion of the first support frame 1 is provided at the top end with a knuckle member 12 having an axial hole 120, and a hole 11 in the middle.

The second support frame 2 is a substantially U-shaped frame formed from a pipe, having a transverse lower portion directly disposed on the ground or the floor as a base, and two vertical portions upwardly extended from two opposite ends of the transverse lower portion. Each vertical portion of the second support frame 2 has a top end 22 coupled to the vertical portions of the first support frame 1 by one union 6, and is provided with a hole 21 in the middle.

The struts 7 are respectively connected between the first support frame 1 and the second support frame 2. Each strut 7 has one end fastened to the hole 11 of one vertical portion of the first support frame 1, and an opposite end fastened to the hole 21 of the corresponding vertical portion of the second support frame 2.

The unions 6 are respectively mounted on the vertical portions of the first support frame 1 below the knuckle members 12 and fixed thereto by pins 60, and pivoted to the two top ends 22 of the second support frame 2. Each union 6 is provided with a transverse locating axle 61, which limits the pivoting angle of the second support frame 2 relative to the first support frame 1.

The first swing member 4 has a top end terminating in a hand grip 42 and provided with a first connecting member 41 below the hand grip 42, and a bottom end provided with a foot plate 40. The first connecting member 41 of the first swing member 4 is pivotably mounted in the axial hole 120 of one knuckle member 12 of the first support frame 1, therefore the first swing member 4 can be turned about an axis.

The second swing 5 has a top end terminating in a hand grip 52 and provided with a first connecting member 51 below the hand grip 52, and a bottom end provided with a foot plate 50.

The first connecting member 51 of the second swing member 5 is pivoted to one knuckle member 12 of the first support frame 1, therefore the second swing member 5 can be turned about an axis.

Figure 4:
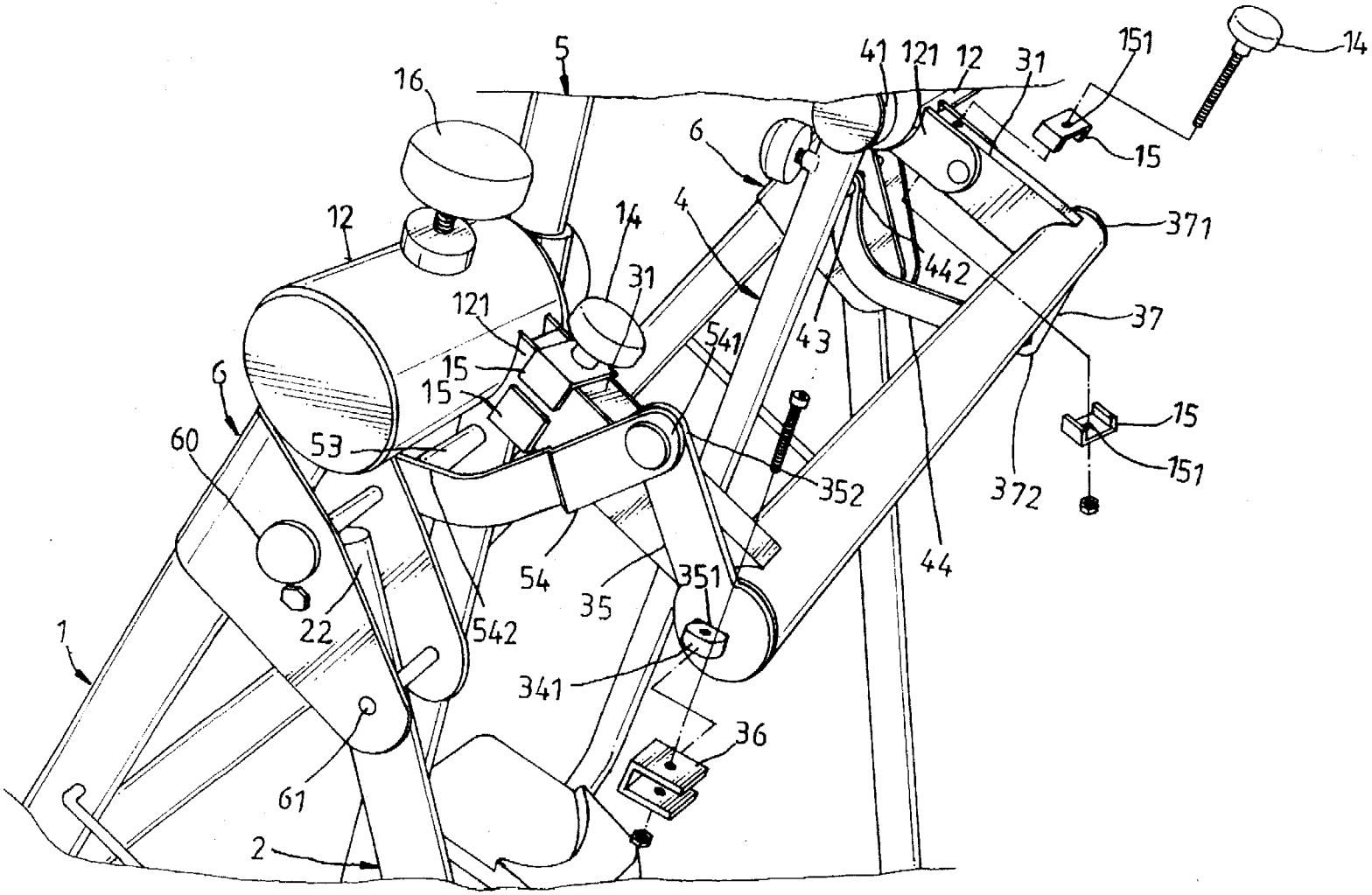
FIG. 4 is a partial view in an enlarged scale of a part of FIG. 3.
Figure 5:
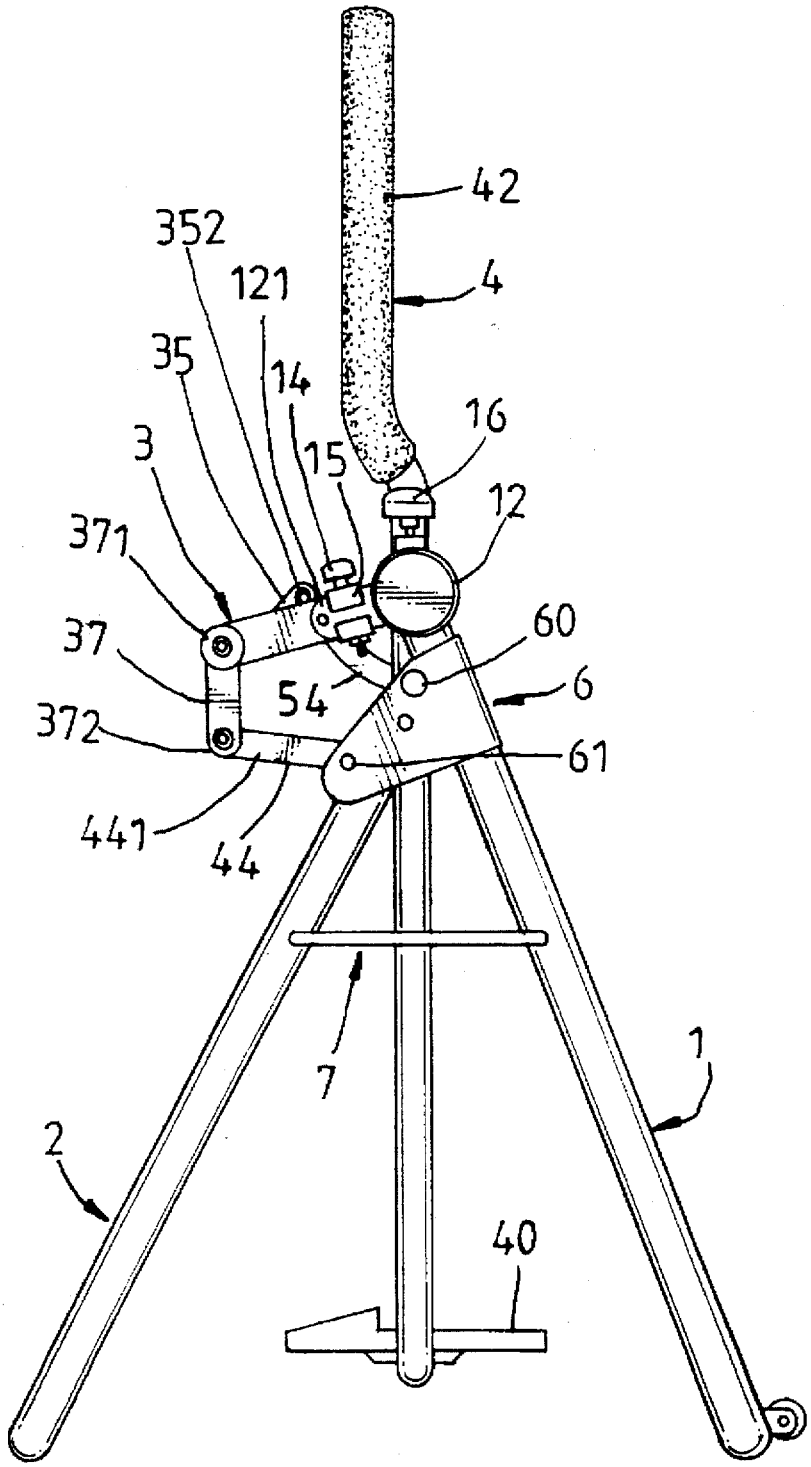
FIG. 5 is a side view of the jogger exerciser shown in FIG. 3.
Figure 8:
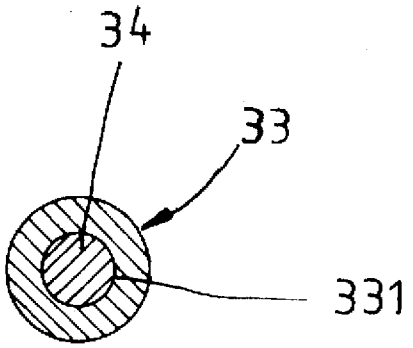
FIG. 8 is a cross sectional view of the transverse top frame according to the present invention.

The main characteristics of the present invention are outlined hereinafter. The transverse bar 33 of the transverse top frame 3 has an axial hole 331 (see FIG. 8). A pivot 34 is mounted in the axial hole 331 of the transverse bar 33. The pivot 34 has one end 341 extended out one end of the axial hole 331 of the transverse bar 33 and coupled to a hole 351 at a bottom end of a first front link 35 by a filtering 36 (see FIG. 4). The first front link 35 has a top end 352 pivoted to a top end 541 of a first rear link 54. The opposite end 342 of the pivot 34 extended out of an opposite end of the axial hole 331 of the transverse bar 33 and coupled to a top end 371 of the second front link 37. The second front link 37 has a bottom end 372 pivoted to a rear end 441 of a second rear link 44.

The second swing member 5 is provided with a second connecting member 53 disposed in parallel to and below the first connecting bar 51 and connected to the bottom end 542 of the first rear link 54.

The first swing member 4 is provided with a second connecting member 43 disposed in parallel to and below the first connecting member 41 and connected to the front end 442 of the second rear link 44.

Figure 6:
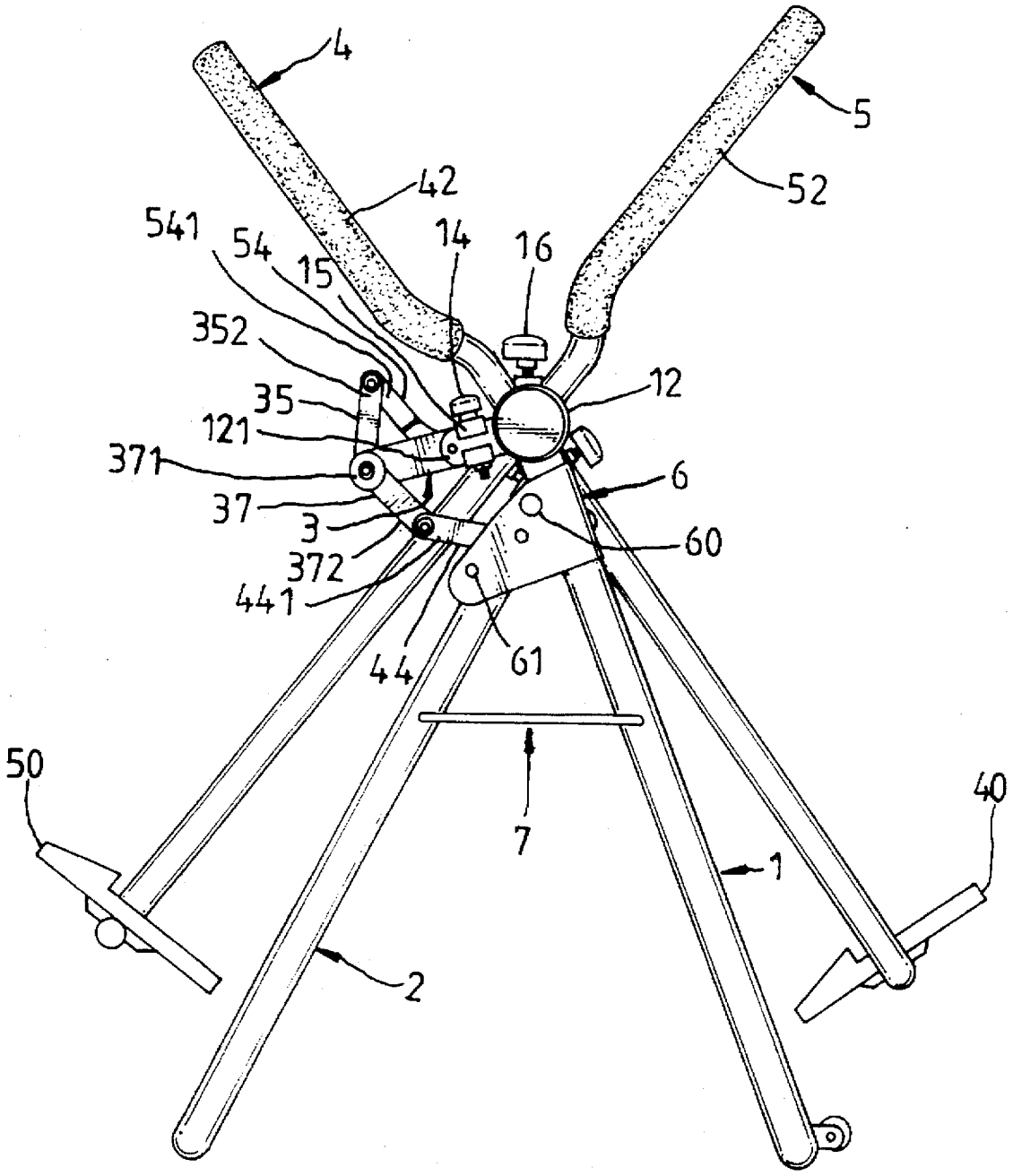
FIG. 6 is an applied view of the present invention, showing the first swing member moved to the back side and the second swing member moved to the front side.
Figure 7:
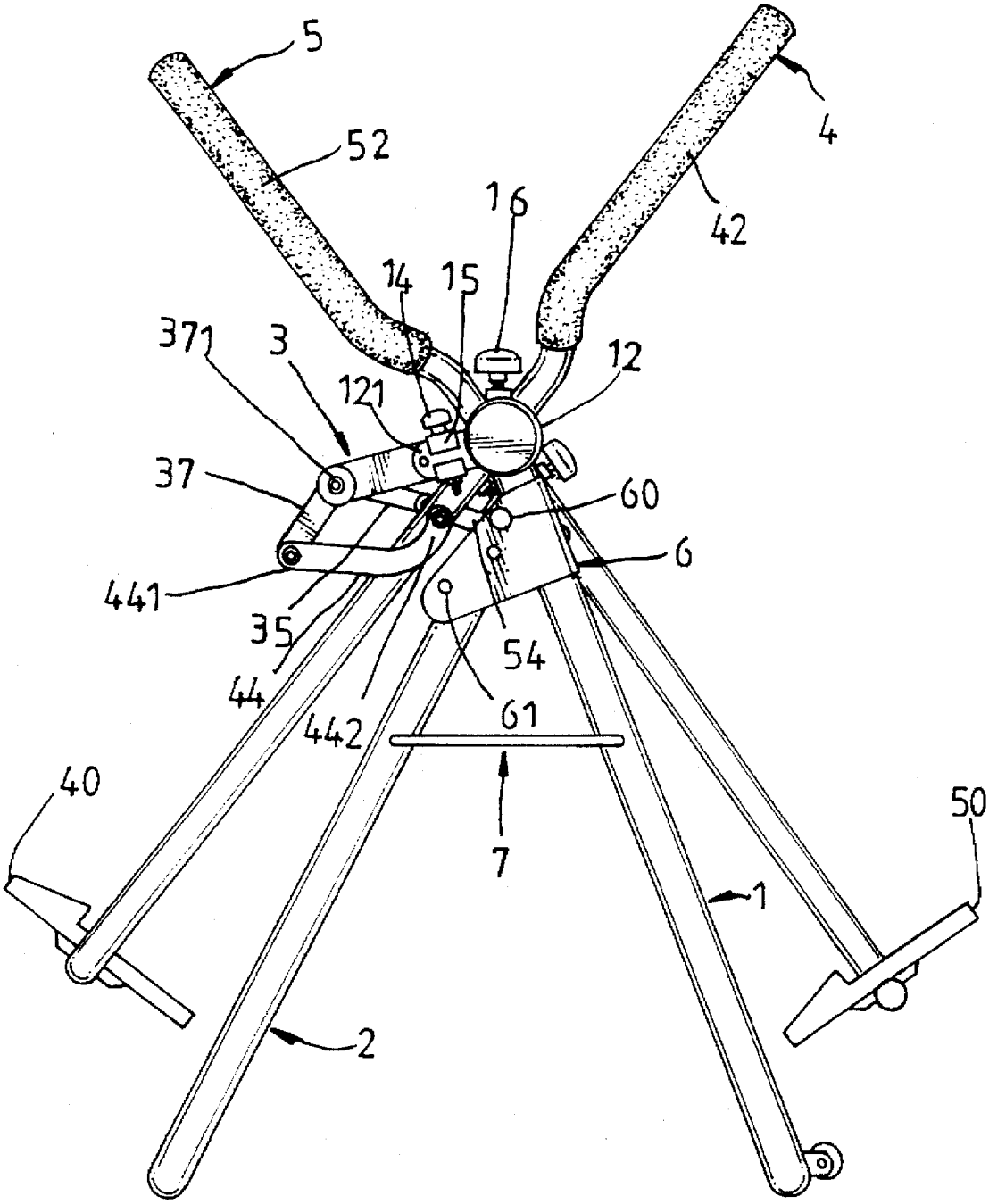
FIG. 7 is another applied view of the present invention, showing the first swing member moved to the front side and the second swing member moved to the back side.

Referring to FIGS. 6 and 7, when the first swing member 4 and the second swing member 5 are alternatively swung back and forth as shown in FIGS. 6 and 7, the second connecting member 43 of the first swing member 4 and the second connecting member 53 of the second swing member 5 are forced to move the second rear link 44, the second front link 37, the first rear link 54 and the first front link 35. Therefore, the alternative swinging motion of the first swing member 4 and the second swing member 5 are stable, and the second rear link 44, the second front link 37, the first rear link 54 and the first front link 35 limit the swinging angle of the first swinging member 4 and the second swing member 5 within a safety range.

The knuckle members 12 of the first support frame have a respective substantially U-shaped lug 121 at the back side respectively pivoted to the backward bars 31 of the transverse top frame 3 by a respective pivot 13. Two substantially U-shaped locating frames 15 are respectively fastened to the lugs 121 of the knuckle members 12 and the backward bars 31 of the transverse top frame 3. Tightening up screws 14 are respectively threaded into respective screw holes 151 on the locating frames 15 to fix the locating frames 15, the lugs 121 of the knuckle members 12 and the backward bars 31 of the transverse top frame 3 together. When the tightening up screws 14 are unfastened and the locating frames 15 are removed, the transverse top frame 3 can then be turned downwards and closely attached to the first support frame 1. When the pins 60 are disconnected from the unions 6, the second support frame 2 and the first support frame 1 can then be collapsed and closely attached to each other.

Figure 9:
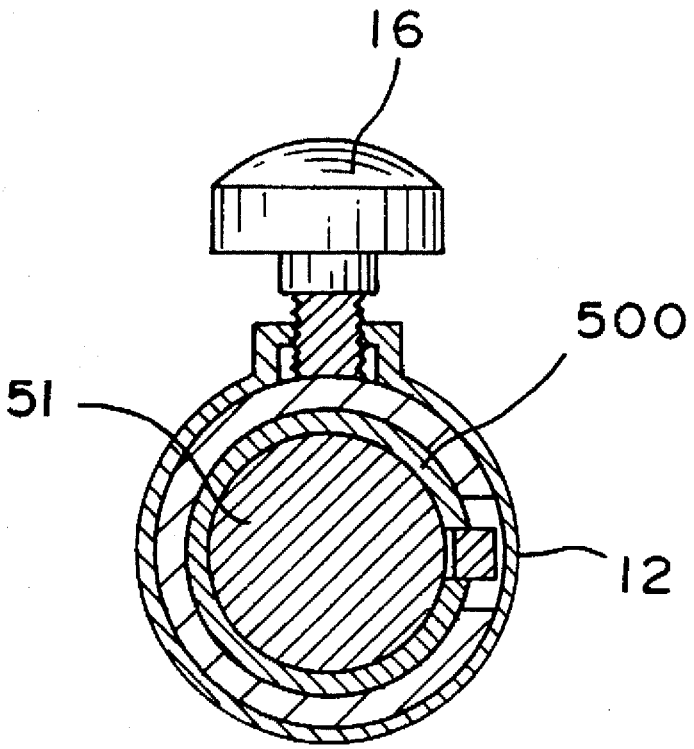
FIG. 9 is a cross sectional view of a knuckle member according to the present invention.

As shown in FIG. 9, a lining 500 is mounted within the axial hole 120 of each knuckle member 12, and sandwiched between the axial hole 120 and a first connecting member 41 or 51. An adjusting screw 16 is mounted in each knuckle member 12. By means of turning the adjusting screw 16 forwards or backwards, the friction resistance between the lining of one knuckle member 12 and the first connecting member 41 or 51 of the first swing member 4 or second swing member 5 is adjusted.

I claim:

1. A jogger exerciser comprising:

a first support frame formed from a U-shaped pipe having a transverse lower portion and two upwardly extended vertical portions;

two unions respectively mounted on the vertical portions of said first support frame;

a first knuckle member and a second knuckle member respectively and fixedly mounted on the vertical portions of said first support frame;

a second support frame formed from a U-shaped pipe having a transverse lower portion and two upwardly extended vertical portions respectively pivoted to said unions;

two struts respectively connected between the vertical portions of said first support frame and the vertical portions of said second support frame;

a transverse top frame connected between said knuckle members, said transverse top frame comprising a transverse bar, and two backward bars perpendicularly extended from two opposite ends of said transverse bar and respectively connected to said knuckle members;

a first swing member having a top end terminating in a hand grip, a bottom end terminating in a foot plate, and a first connecting member fixedly secured thereto below the hand grip of said first swing member and pivoted to said first knuckle member; and a second swing member having a top end terminating in a hand grip, a bottom end terminating in a foot plate, and a first connecting member fixedly secured thereto below the hand grip of said second swing member and pivoted to said second knuckle member;

wherein:

said transverse bar of said transverse top frame comprises an axial hole, a pivot mounted in said axial hole and having a first end and a second end respectively extended out of two opposite ends of said axial hole;

said first swing member is provided with a second connecting member parallel to and below the respective first connecting member;

said second swing member is provided with a second connecting member parallel to and below the respective first connecting member;

a first front link and a first rear link are pivoted together and coupled between the first end of said pivot of said transverse bar and the second connecting member of said first swing member, said first front link having a bottom end pivoted to the first end of said pivot and a top end, said first rear link having a top end pivoted to the top end of said first front link and a bottom end pivoted to the second connecting member of said first swing member;

a second front link and a second rear link are pivoted together and coupled between the second end of said pivot of said transverse bar and the second connecting member of said second swing member, said second front link having a top end pivoted to the second end of the pivot of said transverse bar and a bottom end, said second rear link having a rear end pivoted to the bottom end of said second front link and a front end pivoted to the second connecting member of said second swing member; and a frictional means located within said first and second knuckle members for adjusting the resistance to rotation of said first connecting members.

2. The jogger exerciser of claim 1 wherein said first and second knuckle members have a respective substantially U-shaped lug at a back side respectively pivoted to the backward bars of said transverse top frame, and fixedly secured in position by a respective substantially U-shaped locating frame and a respective tightening up screw, said U-shaped locating frame being detachably secured to the U-shaped lug and one backward bar by the respective tightening up screw.

* * * * *